US005204651A

United States Patent [19]

Fiorentini et al.

[11] Patent Number: 5,204,651

[45] Date of Patent: Apr. 20, 1993

[54] ELEMENTARY CELL COMBINABLE TO FORM DOT MATRIX DISPLAYS

[75] Inventors: Antonio Fiorentini, Milan; Claudio Perissinotto, Martignacco, both of Italy

[73] Assignee: Solari Udine S.p.A., Udine, Italy

[21] Appl. No.: 804,822

[22] Filed: Dec. 6, 1991

[30] Foreign Application Priority Data

Dec. 12, 1990 [IT] Italy ..... 22360 A/90

[51] Int. Cl.[5] ..... G08B 5/00

[52] U.S. Cl. ..... 335/219; 340/815.05; 340/815.26; 40/426

[58] Field of Search ..... 340/764, 783, 815.1, 340/815.05, 815.08, 815.09, 815.26, 815.33; 40/426, 429, 430, 449

[56] References Cited

U.S. PATENT DOCUMENTS

| | | | |
|---|---|---|---|
| 2,585,974 | 2/1952 | Taylor et al. | 340/815.26 |
| 3,036,300 | 5/1962 | Knight | 340/815.26 |
| 3,267,455 | 8/1966 | McGuire | 340/373 |
| 3,364,481 | 1/1968 | Fuzzell | 340/815.26 |
| 3,425,055 | 1/1969 | Pihl | 340/815.26 |
| 3,451,055 | 6/1969 | Pihl | 340/815.26 |
| 3,469,258 | 9/1969 | Winrow | 340/764 |
| 3,487,403 | 12/1969 | Pihl | 340/815.26 |
| 3,634,857 | 1/1972 | Pihl | 340/373 |
| 3,680,083 | 7/1972 | Pihl | 340/815.26 |
| 3,772,686 | 11/1973 | Chardon | 340/815.26 |
| 3,872,469 | 3/1975 | Loughran | 340/373 |
| 3,924,226 | 12/1975 | Lacy et al. | 340/336 |
| 4,006,476 | 2/1977 | Romney | 340/373 |
| 4,128,825 | 12/1978 | Madsen | 340/373 |
| 4,394,652 | 7/1983 | Rabette | 340/764 |
| 4,401,959 | 8/1983 | Enright et al. | 340/815.26 |
| 4,769,638 | 9/1988 | Woolfolk | 340/763 |
| 4,811,008 | 3/1989 | Woolfolk | 340/763 |

FOREIGN PATENT DOCUMENTS

| | | | |
|---|---|---|---|
| 2540266 | 8/1984 | France | 340/815.26 |

*Primary Examiner*—Leo P. Picard
*Assistant Examiner*—Ramon M. Barrera
*Attorney, Agent, or Firm*—Hedman, Gibson & Costigan

[57] ABSTRACT

An elementary cell combinable to form dot matrix displays, in which a plurality of plates of non-magnetic insulating material, at least one of which is in contact with a plate of high magnetic permeability, define a seat for housing a polychrome sphere provided internally with a permanent magnet. In the plates of non-magnetic material there are arranged magnetic poles, which can be energized selectively to cause the sphere to rotate into predetermined positions.

25 Claims, 6 Drawing Sheets

ELEMENTARY CELL COMBINABLE TO FORM DOT MATRIX DISPLAYS

This invention relates to an elementary cell combinable to form dot matrix displays.

The need to present coloured alphanumerical and graphic messages to increasingly numerous groups of individuals has led in recent years to research and development of systems able to provide visual information rapidly and easily updatable on a macroscopic scale.

These video-informative systems are generally interfaced with a data transmission network and can therefore be considered as output peripherals for electronic image processors.

On the basis of the physical principles involved in obtaining the effects, display means can be divided into active and passive depending on whether they emit light energy or rediffuse it. Video-informative systems using active display means are generally known for their high electrical energy consumption, which combined with the equipment cost makes their use decidedly disadvantageous. On the other hand, known passive display means have poor optical characteristics and a somewhat limited facility for colour combination.

An object of the present invention is to provide an elementary cell which can be combined into a matrix suitable for forming displays of passive, active or double active/passive type in relation to the environmental lighting conditions, with a multicolour base and a high image switching rate.

A further object of the present invention is to achieve maximum combinability together with good optical characteristics, so as to be easily able to form from elementary cells representative surfaces having visual and dimensional characteristics able to satisfy the most severe requirements.

These objects are achieved by an elementary cell combinable to form dot matrix displays, in which a plurality of plates of non-magnetic insulating material, at least one of which is in contact with a plate of high magnetic permeability, are arranged to define a seat for housing a sphere provided internally with a permanent magnet, said plates housing a plurality of energizable magnetic poles, said sphere having a polychrome outer surface divided into sectors, at least one of said plates being provided with a window displaying a portion of said sphere and with a transparent closure element, characterised in that the permanent magnet contained within said sphere comprises composite spatial-surface geometrical shapes in the form of depressions, reliefs and contours, said geometrical shapes being in correlation with other similar shapes on said energizable magnetic poles, said magnet interacting with said plurality of energizable poles and with said geometrical shapes to cause said sphere to assume a combination of n positions where n is even and is greater than or equal to 2.

According to one embodiment of the present invention, the poles are four in number, arranged within said plurality of non-magnetic insulating plates at the vertices of a tetrahedron; the plate in contact with that of high magnetic permeability carries one of the poles centrally, within a housing seat, in such a manner as to define a first vertex of the tetrahedron, the other three poles lying coplanar and arranged at the vertices of an equilateral triangle opposite the first vertex and in proximity to the display window.

According to other production processes the plurality of plates can be different, provided that in a determined stage of the process two separate parts each carrying a spherical semi-impression can close about said chromatic sphere to form its housing seat and constitute the effective elementary cell. In addition, the chromatic sphere can be faceted at least at predetermined positions to obtain special effects, the facets preferably being sunken in order not to compromise the ability to rotate within the housing seat.

Specifically, the poles consist of a metal stem provided at one end with an essentially frusto-conical or frusto-pyramidal head having a composite concave surface facing the interior of the seat housing the sphere. Preferably but not limitatively the composite concave surface comprises a spherical cap portion concentric with a similar cap situated on said permanent magnet.

Again according to the invention, on the concave surface of those poles arranged in said equilateral triangle, there is provided a depression which also involves part of the contour of said concave surface such that the depression is offset by 120° on each pole in succession.

Preferably within the cell there is provided a colourless transparent liquid of suitable viscosity having a density equal to the sum of the weights of the sphere and magnet divided by the relative total volume, in order to form a hydrostatic suspension of kinetic effect which damps the movements of the sphere. According to the invention, for each pole stem there is provided an energizing winding, arranged in suitable seats in the plates of non-magnetic insulating material.

In addition the frusto-concial or frusto-pyramidal surface which surrounds the display window is a reflecting surface.

Microbeads of transparent material can be interposed between the sphere and its housing seat to reduce friction during the rotation of the sphere without altering its chromatic appearance.

The permanent magnet is contained within a seat provided in the interior of the sphere and consist, according to two preferred embodiments of the present invention, of a prismatic or cylindrical body of rigid magnetic material with the axis of said prismatic or cylindrical body being parallel to the magnetization intensity centered through the magnet volume. The prismatic or cylindrical body of said permanent magnet is provided with surfaces not parallel to the axis of said body, which complete the definition of the permanently magnetized volume, said surfaces consisting, by way of non-limiting example, of spherical caps pertaining to spheres internally concentric to said sphere containing said permanent magnet, said caps being spaced apart by annular and/or eccentric depressions. The surfaces thus defined are semi-symmetrical about the plane passing through the centre of said sphere and normal to the axis of magnetization.

According to a first embodiment of this invention, the permanent magnet consists of a prismatic rigid body of essentially hexagonal plan, with spherical cap bases provided with depression and relief zones arranged semi-symmetrical about the plane passing through the centre of said sphere and normal to the axis of magnetization, said bases being also provided with shaped recesses.

A further embodiment of said permanent magnet comprises a first cylindrical element surrounded coaxially by a second cylindrical element and connected to the first by spherical cap portions and annular grooves, said first internal element being provided with bases presenting spherical cap portions and concave sunken portions arranged semi-symmetrically about the plane passing through the centre of said sphere and normal to the axis of magnetization.

Advantageously the outer surface of the sphere is divided into eight equal parts, which in practice represent spherical surface portions tending towards a spherical triangle of area $\frac{1}{2}\pi r^2$. It should be noted that the sphere interacting with the poles assumes eight unequivocally defined spatial positions, in such a manner as to present for each position a portion of its polychrome surface to said window.

Again according to this invention the permanent magnet and a magnetic field generated by the selective energization of said poles possess an axial symmetry, a specular symmetry, and a central semi-symmetry.

The technical characteristics and further advantages of the present invention will be more apparent from the description given hereinafter by way of non-limiting example with reference to the accompanying drawings, in which.

Figure 1:
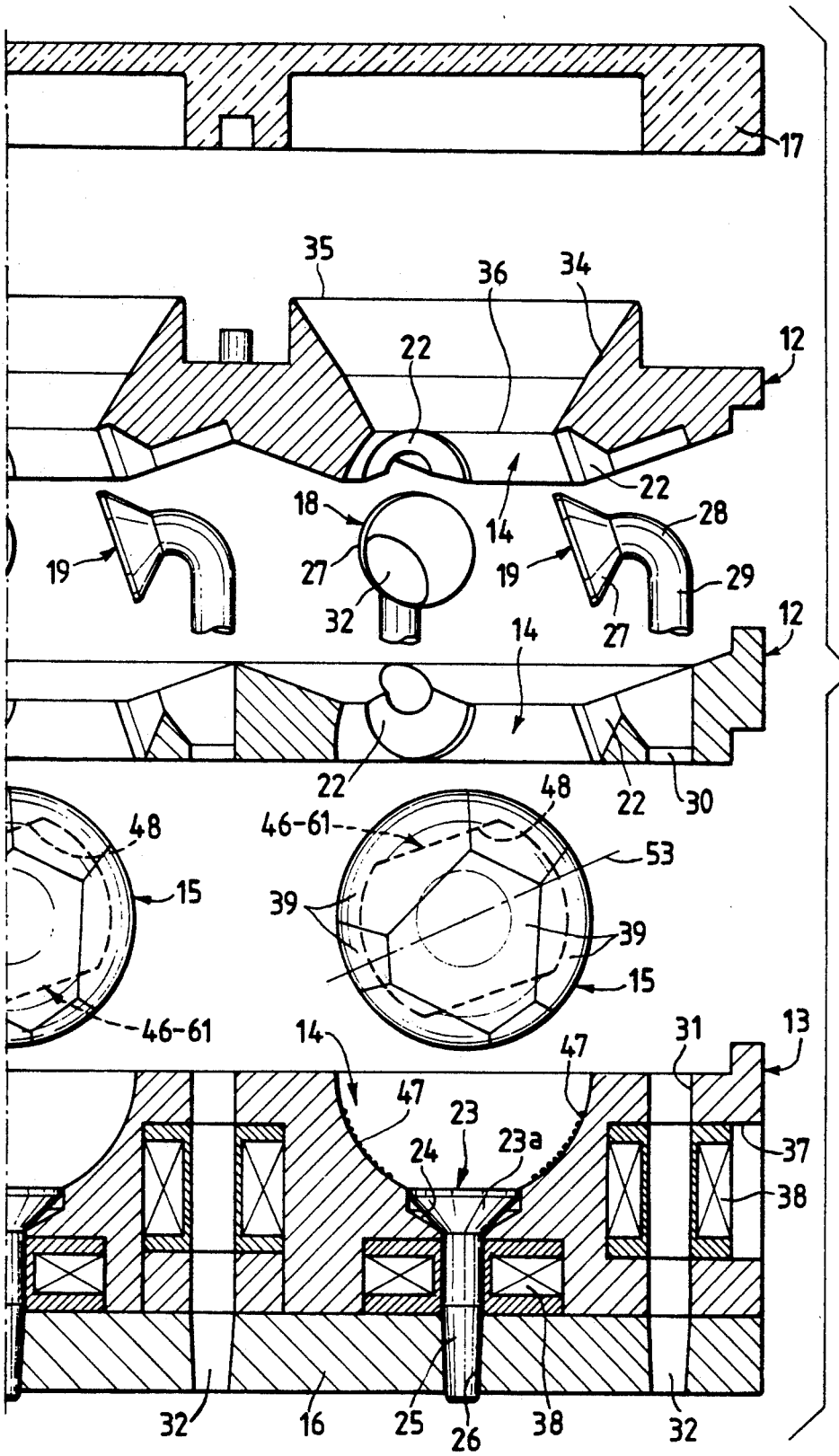
FIG. 1 is an overall exploded view of the elementary cell according to the invention comprising a polychrome sphere.
Figure 2:
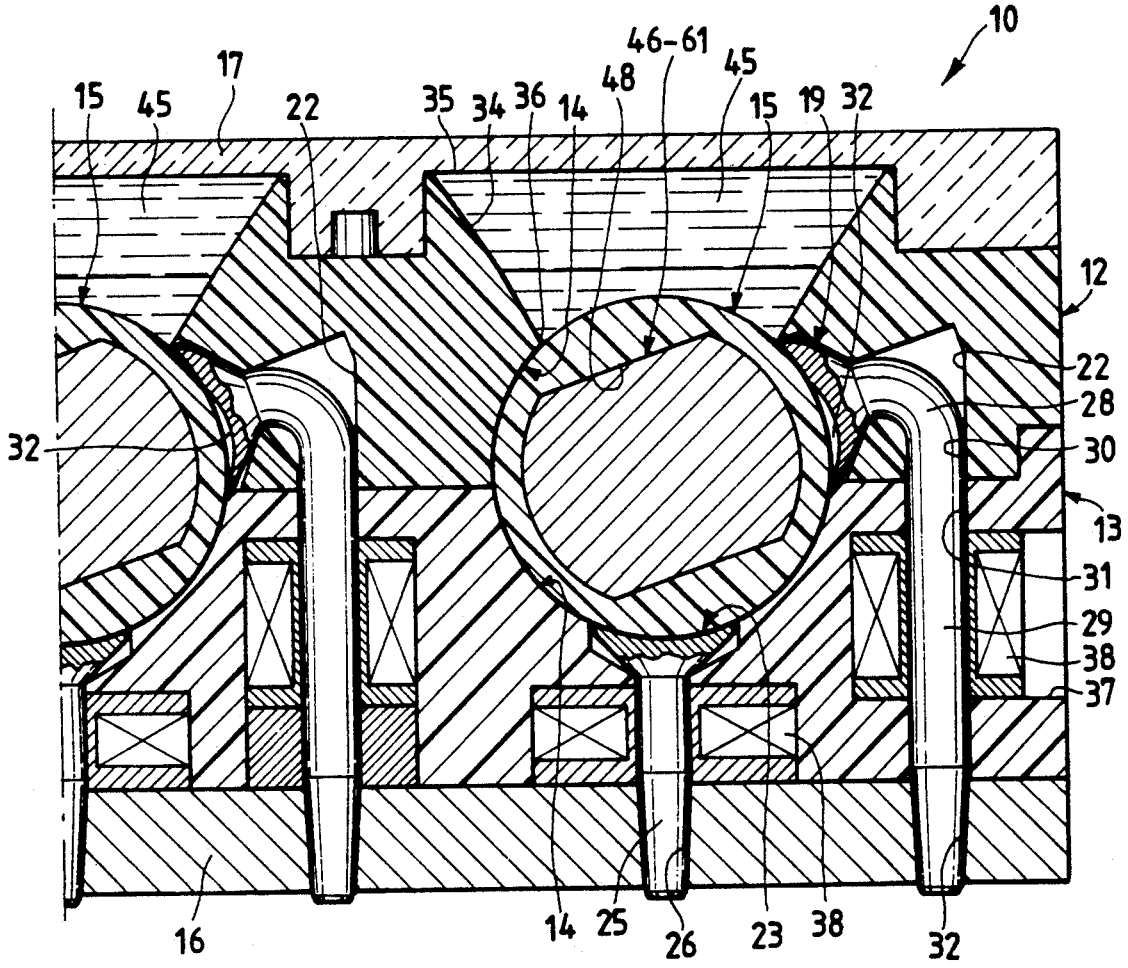
FIG. 2 is a mounted sectional view of the elements of FIG. 1.
Figure 3:
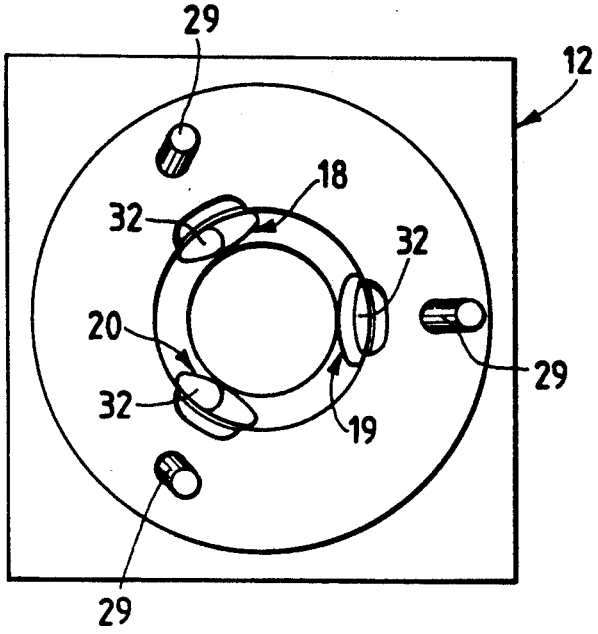
FIG. 3 is a plan view from below of certain elements of FIG. 1 arranged above the sphere.
Figure 4:
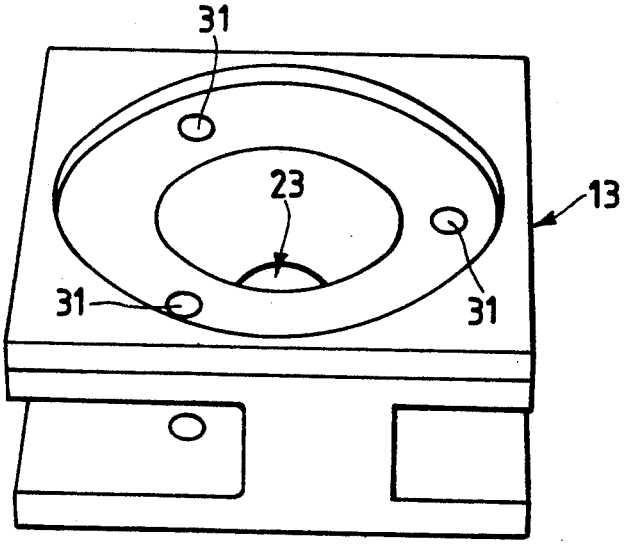
FIG. 4 is a plan view from above of a further element of FIG. 1 arranged below the sphere.
Figure 5:
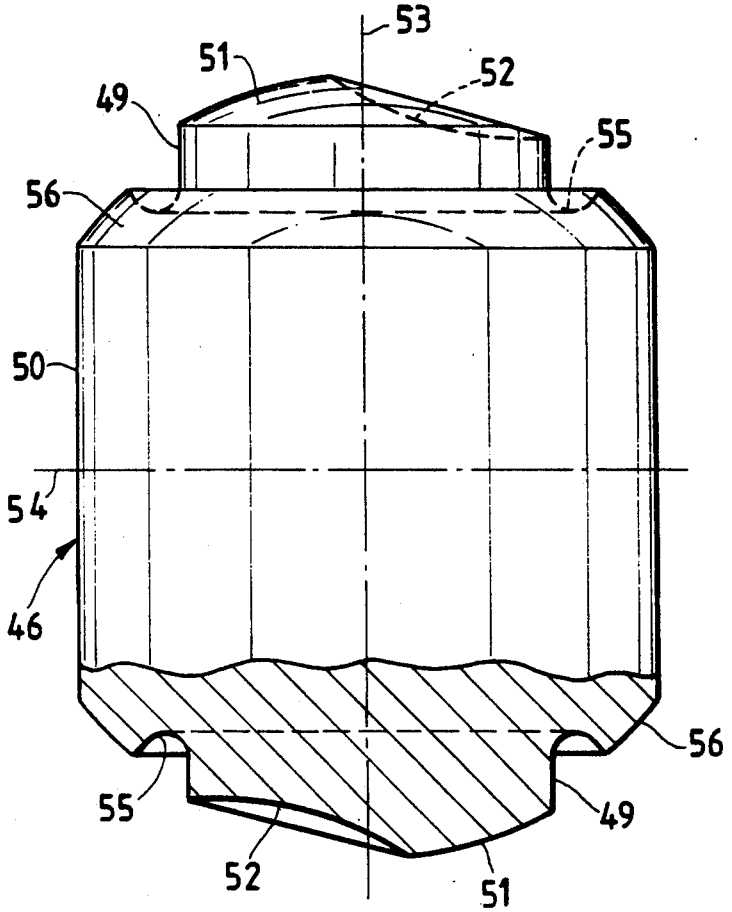
FIGS. 5 and 6 are two views of a permanent magnet contained within the sphere.
Figure 6:
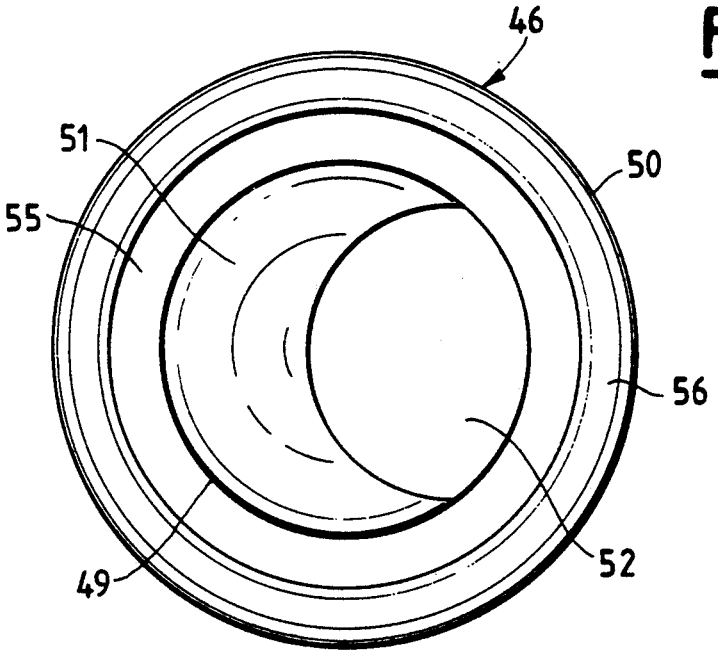

In the figures, the reference numeral 10 indicates overall an elementary cell combinable to form dot matrix displays.

The cell 10 consists of a plurality of plates of non-magnetic insulating material indicated by the reference numerals 12 and 13 and arranged to define a housing seat 14 for a sphere 15. The plate 13, below 12, is in contact with a plate 16 of metal, preferably soft iron.

Above the plate 12 there is a transparent closure element 17. Within the plate 12 there are housed energizable magnetic poles 18, 19 and 20 in seats 22 formed during the moulding or construction of the piece.

A further energizable magnetic pole 23 is housed in an appropriate seat 24 provided in the plate 13. The pole 23 consists of a straight stem 25 extending from the plate 13 to the high magnetic permeability plate 16 via a through hole 26, plus an essentially frusto-conical head 23*a*.

According to preferred embodiments of the present invention, the magnetic poles 18, 19 and 20 consist of essentially frusto-pyramidal or frusto-conical heads 27 with a composite concave surface and metal stems comprising curved portions 28 and straight portions 29 which pass through holes 30 provided through the plate 12, holes 31 provided through the plate 13 and holes 32 provided through the high magnetic permeability plate 16.

Said holes are aligned, and both the holes 30 and the holes 31 can be formed directly during the construction of the plate 12, for example by moulding.

Figure 7:
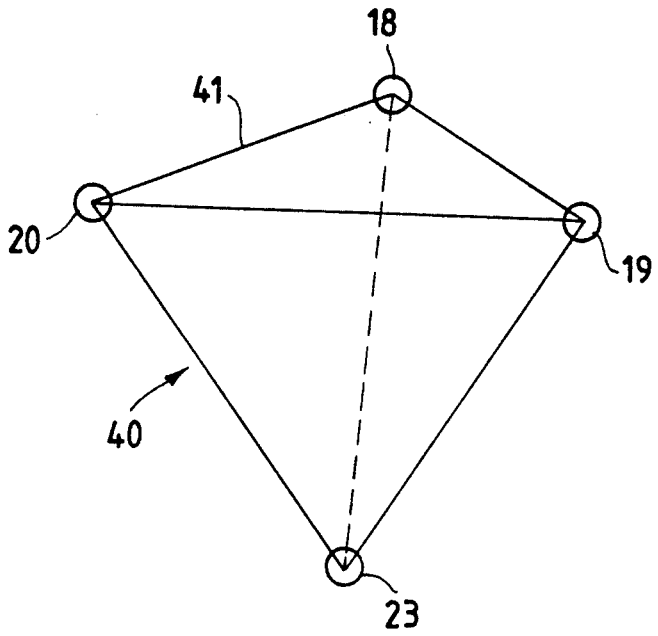
FIG. 7 is a schematic view showing the spatial arrangement of certain elements of FIG. 1.

As can be seen from FIG. 7, the magnetic poles 18, 19, 20 and 23 are arranged at the vertices of a tetrahedron 40 facing downwards, the poles 18, 19 and 20 then being coplanar with each other and arranged at the vertices of the base triangle 41 of the tetrahedron while the pole 23 is opposite the plane of these latter to define the vertex of the tetrahedron 40 within the seat 24 of the plate 13.

Figure 8:
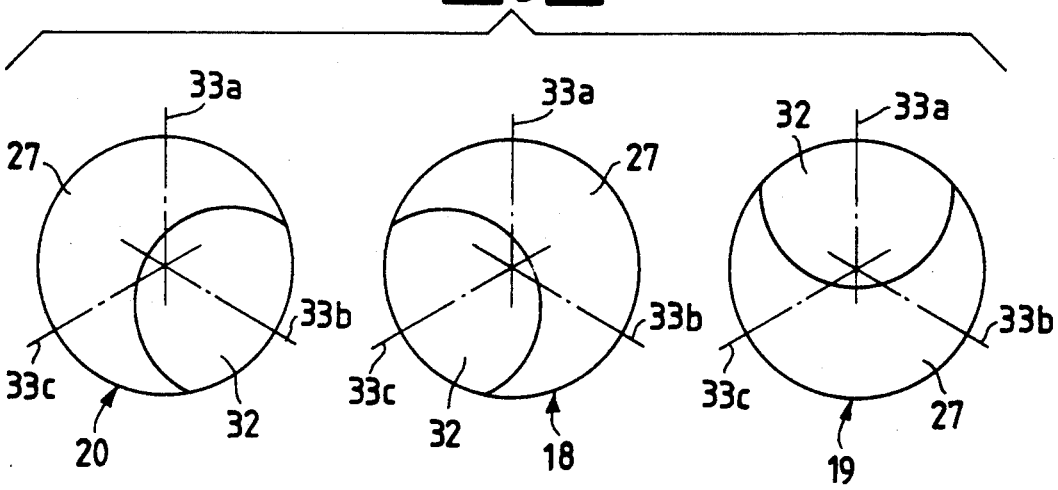
FIG. 8 is a schematic illustration showing the angular arrangement of certain parts of elements of FIGS. 1 and 3.
Figure 9:
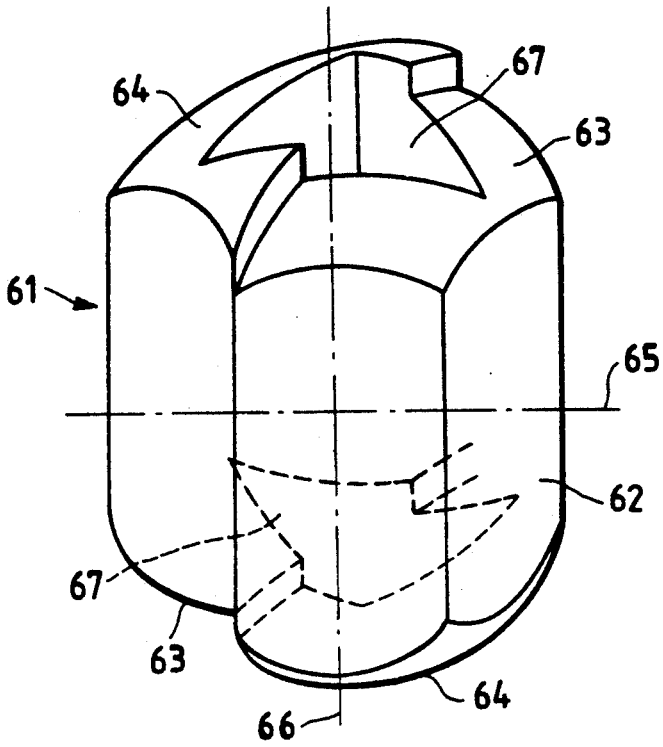
FIG. 9 is a perspective view of a further example of a permanent magnet contained within the sphere.

In addition, according to one embodiment of the present invention, on the composite concave surface of the heads 27, and preferably only on the poles 18, 19 and 20, there are provided depressions 32 which involve part of the contour of said surface, with the angular arrangement shown in FIG. 8. From this latter figure it can be seen that by dividing the surface of each head 27 into three equal parts and giving the axes 33*a*, 33*b*, 33*c* the angular values of 0°, 120° and 240°, the depression formed on the head of the pole 19 is situated on the axis indicating 0°, the drpression formed on the head of the pole 20 is situated on the axis indicating 120°, and depression formed on the head of the pole 18 is situated on the axis indicating 240°.

Figure 10:
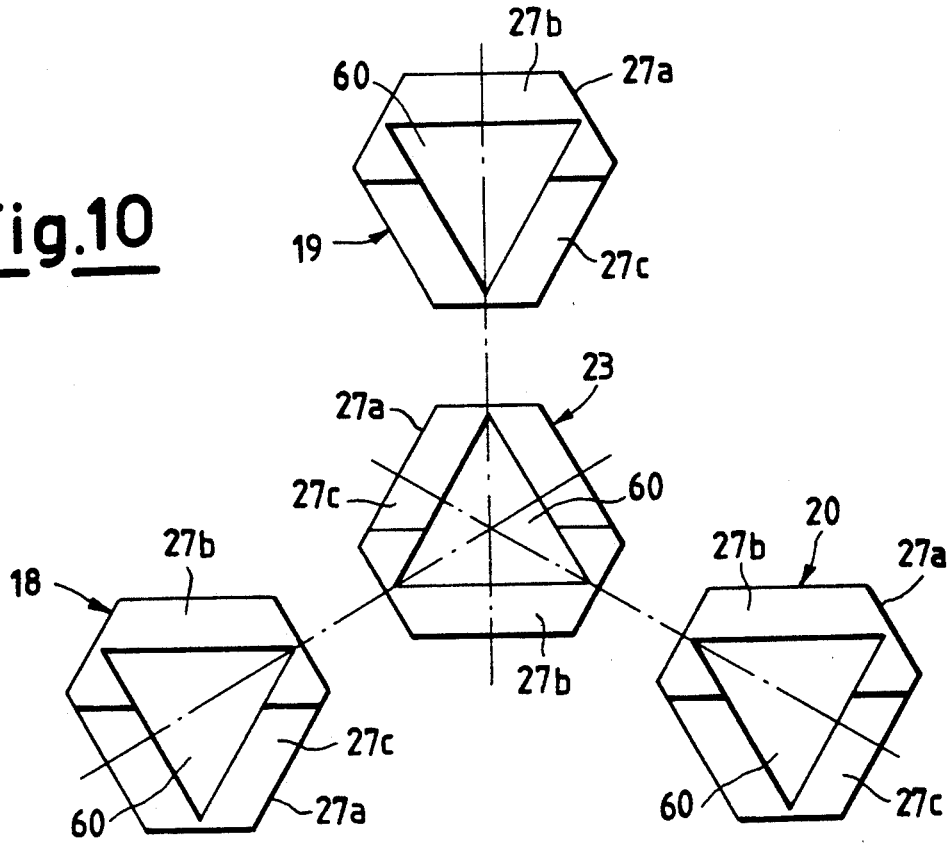
FIG. 10 is a schematic illustration showing the angular arrangement of certain parts of a further example of the elements of FIGS. 1 and 3.

In a further preferred embodiment shown in FIG. 10, the heads of the poles 18, 19 and 20 are frusto-pyramidal. These heads, indicated by 27*a*, are essentially of hexagonal plan and comprise a composite concave surface with a projecting spherical cap portion 27*b* and a sunken spherical cap portion 27*c*. Centrally within the frusto-pyramidal heads 27*a* there are provided triangular recesses 60, the arrangement of projecting and sunken caps and recesses being such that on each pole they are offset in succession by 120°, as in the case of the depressions 32 of the heads 27. In this case, the pole 23 in the plate 13 is provided with the same head 27*a* as the poles 18, 19 and 20.

The plate 12 is provided upperly with a display window 34 which in a preferred embodiment is essentially either frusto-conical or frusto-pyramidal with its major base 35 facing upwards, whereas the minor base 36 allows viewing of a surface portion of the sphere 15 equal or approximately equal to $\frac{1}{8}$ of the sphere. In the outer surface of the plate 13 there are provided seats 37 to house energization windings 38 which interact with the stems 25 and 29 of the magnetic poles 23, 18, 19 and 20 respectively. The sphere 15 housed in the seat 14 has its outer surface preferably divided into eight equal parts indicated by the reference numeral 39, each of the parts 39 being coloured with a different colour but at least two of the parts 39 being black and white. From this it follows that the optimum coloured area of each part 39 tends towards or can be equal to $\frac{1}{2}\pi r^2$ where r is the sphere radius.

According to this invention it is however possible to divide the sphere surface into equal area parts other than a spherical triangle (of area $\frac{1}{2}\pi r^2$) but in this case the entire useful area of the sphere 15 will not be completely used.

Within the seat 14 and display window 34, in contact with the sphere, there is a perfectly transparent liquid indicated schematically by 45 of appropriate viscosity, and having a density such that the hydrostatic thrust on the sphere 15, inside which a permanent magnet 46 or 61 is provided, substantially balances its total weight. If the weights of the sphere 15 and of the permanent magnet 46 are indicated by $P_1$ and $P_2$ respectively and the volume defined by the sphere is indicated by V, the density of the liquid 45 will be approximately $(P_1+P_2)/V$.

The viscosity of the liquid 45 is advantageously chosen such that it damps the rotational kinetic energy of the sphere 15 and also creates a lubricant film between this latter and the seat 14. To further reduce the friction between the sphere 15 and the seat 14 there are provided, between these latter, a plurality of microbeads 47 of diameter not exceeding r/4.

In coupling relationship with the heads 27*a* there is preferably provided a permanent magnet 61 consisting of a rigid prismatic body of essentially hexagonal plan 62, with spherical cap bases provided with depression zones 63 and relief zones 64 arranged semi-symmetrical about the plane 65 passing through the centre of the sphere 15 and normal to an axis 66 parallel to the magnetization intensity centered through the magnet volume. The bases are also provided with triangularly shaped recesses indicated by 67.

As shown in the figures, the permanent magnet 46 or 61 is housed in a suitable seat 48 provided within the sphere 15.

In coupling relationship with the heads 27 it may be preferred to use the permanent magnet 46 housed in the seat 48 provided within the sphere 15 and consisting of a first inner cylindrical element 49 surrounded by a second outer cylindrical element 50. The element 49 has bases consisting of a spherical cap portion 51 and a sunken concave portion 52 facing the outside of the sphere. Thus also for the permanent magnet 46 there is defined a longitudinal permanent magnet axis 53 which is parallel to the magnetization intensity centered through the magnet volume, and a plane 54 passing through the centre of the spere 15 and normal to the axis 53.

The outer cylindrical element 50 is connected to the inner cylindrical element 49 by two annular grooves 55 and further spherical cap portions In this manner an axial symmetry, a specular symmetry and a central semi-symmetry are achieved both for the permanent magnet 46 and for the permanent magnet 61, these symmetries also applying to the relative magnetic field in which the permanent magnet is immersed.

The elementary cell 10 formed in this manner enables the sphere 15, on the basis of the chosen energization for the magnetic poles, to assume eight positions unequivocally defined in space so that for each position a determined part 39 of its surface is presented to the display window 34.

The unequivocal definition of these eight positions is determined by the particular configuration of the magnetic field (quadripolar configuration) with the poles orientated along the aforedescribed axes of the tetrahedron and by the particular shape of the permanent magnet 46 and 61 contained within the sphere 15.

The characteristic which makes the system effective is the presence on the heads 27 and 27*a* of the respective depressions 32 and recesses 60.

This, together with the particular constructional shapes of the permanent magnet as illustrated by way of example results in a magnetic field distribution giving a particular symmetry about a plane which, for each pole, is rotated through 120° relative to that of the two adjacent poles.

A further characteristic is that the division of the outer surface of the sphere 15 into equal parts must be related to the position of the permanent magnet 46 or 61 and to the configuration of the magnetic field in that each surface part 39 must coincide with the spatial positions into which the sphere 15 can be moved by energizing the poles.

The mechanical and electromagnetic characteristics described up to this point result inter alia in perfect compatibility between the mechanical components and the operation of the combinable elementary cell and the optical system used for displaying each of these cells.

Besides resulting in low energy consumption, the cell of the present invention enables images of very appreciable quality to be obtained and to be rapidly and accurately changed.

We claim:

1. An elementary cell combinable to form dot matrix displays, in which a plurality of plates of non-magnetic insulating material, at least one of which is in contact with a plate of high magnetic permeability, are arranged to define a seat for housing a sphere provided internally with a permanent magnet, said plates housing a plurality of energizable magnetic poles, said sphere having a polychromatic outer surface divided into sectors, at least one of said plates being provided with a window displaying a portion of said sphere and with a transparent closure element, characterised in that the permanent magnet contained within said sphere comprises composite spatial-surface geometrical shapes in the form of depressions, reliefs and contours, said geometrical shapes being in correlation with other similar shapes on said energizable magnetic poles, said magnet interacting with said plurality of energizable poles and with said geometrical shapes to cause said sphere to assume a combination of n positions where n is even and is greater than or equal to 2.

2. A combinable elementary cell as claimed in claim 1, characterised in that said plurality of poles are four poles, arranged within said plurality of non-magnetic insulating plates at the vertices of a tetrahedron, said at least one of said plates carrying one of the poles centrally, within said housing seat, in such a manner as to define a first vertex of said tetrahedron, the other three of said poles lying coplanar at the vertices of an equilateral triangle opposite said first vertex and in proximity to said display window.

3. A combinable elementary cell as claimed in claim 1, characterised in that said poles consist of a metal stem provided at one end with an essentially frusto-pyramidal or frusto-conical head having a composite concave surface facing the interior of said seat.

4. A combinable elementary cell as claimed in claim 3, characterised in that said composite concave surface comprises a spherical cap portion concentric with a similar cap situated on said permanent magnet.

5. A combinable elementary cell as claimed in claim 3, characterised in that on said composite concave surface there is provided a depression which involves part of the contour of said surface such that the depression is offset by 120° on each pole in succession.

6. A combinable elementary cell as claimed in claim 1, characterised in that an upper portion of said seat, in which said display window is provided, consists of a shaped plate defining seats for housing said sphere and said poles.

7. A combinable elementary cell as claimed in claim 1, characterised in that within said cell there is provided a colourless transparent liquid of suitable viscosity.

8. A combinable elementary cell as claimed in claim 7, characterised in that said liquid has a density equal to the sum of the weights of said sphere and magnet divided by the relative total volume, to form a hydrostatic suspension of kinetic effect which damps the movements of said sphere.

9. A combinable elementary cell as claimed in claim 1, characterised in that for each pole stem there is provided an energizing winding, arranged in suitable seats in said plates of non-magnetic insulating material.

10. A combinable elementary cell as claimed in claim 1, characterised in that the surface which surrounds the display window is a frusto-conical or frusto-pyramidal surface reflecting surface.

11. A combinable elementary cell as claimed in claim 1, characterised in that microbeads of transparent material are interposed between said sphere and its housing seat to reduce friction during the rotation of the sphere without altering its polychromatic appearance.

12. A combinable elementary cell as claimed in claim 1, characterised in that said permanent magnet is contained within a seat provided in the interior of the sphere.

13. A combinable elementary cell as claimed in claim 1, characterised in that said permanent magnet consists of a prismatic or cylindrical body of rigid magnetic material with the axis of said prismatic or cylindrical body being parallel to the magnetization intensity centered through the magnet volume.

14. A combinable elementary cell as claimed in claim 1, characterised in that said permanent magnet consists of a prismatic or cylindrical body of rigid magnetic material provided with surfaces not parallel to the axis of said body, which complete the definition of the permanently magnetized volume, said surfaces consisting of spherical caps pertaining to spheres internally concentric to said sphere containing said permanent magnet, said caps being spaced apart by annular and/or eccentric depressions.

15. A combinable elementary cell as claimed in claim 14, characterised in that said surfaces not parallel to the axis of said body are semi-symmetrical about the plane passing through the centre of said sphere and normal to the axis of magnetization.

16. A combinable elementary cell as claimed in claim 14, characterised in that said permanent magnet consists of a prismatic body of essentially hexagonal plan, with spherical cap bases provided with depression and relief zones arranged semi-symmetrical about the plane passing through the centre of said sphere and normal to the axis of magnetization, said bases being also provided with shaped recesses.

17. A combinable elementary cell as claimed in claim 14, characterised in that said permanent magnet consists of a body in which a first cylindrical element is surrounded coaxially by a second cylindrical element connected to the first by spherical cap portions and annular grooves, said first internal element being provided with bases presenting spherical cap portions and concave sunken portions arranged semi-symmetrically about the plane passing through the centre of said sphere and normal to the axis of magnetization.

18. A combinable elementary cell as claimed in claim 1, characterised in that the outer surface of said sphere is divided into eight equal parts.

19. A combinable elementary cell as claimed in claim 1, characterised in that the outer surface of said sphere is divided into eight portions tending towards the shape of spherical triangles, each of which has a surface area tending towards $\frac{1}{2}\pi r^2$.

20. A combinable elementary cell as claimed in claim 1, characterised in that the outer surface of said sphere is divided into eight equal spherical triangles.

21. A combinable elementary cell as claimed in claim 1, characterised in that said sphere interacting with said poles assumes eight unequivocally defined spatial positions, in such a manner as to present for each position a portion of its polychromatic surface to said window.

22. A combinable elementary cell as claimed in claim 1, characterised in that the body of said permanent magnet and a magnetic field generated by the selective energization of said poles possess an axial symmetry, a specular symmetry, and a central semi-symmetry.

23. A combinable elementary cell as claimed in claim 1, characterised in that said plate of high magnetic permeability is constructed of soft iron.

24. A combinable elementary cell as claimed in claim 1, characterised in that said polychromatic sphere is partially faceted, at least at said n positions.

25. A combinable elementary cell as claimed in claim 1, characterised in that said polychromatic sphere is partially faceted, said facets being sunken.

* * * * *